US006575594B1

(12) United States Patent
Jafari

(10) Patent No.: US 6,575,594 B1
(45) Date of Patent: Jun. 10, 2003

(54) HIGH BAY COMPACT FLUORESCENT LIGHT FIXTURE

(75) Inventor: Andy Ali Jafari, Belden, MS (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/907,081

(22) Filed: Jul. 17, 2001

(51) Int. Cl.[7] ..... F21V 11/00

(52) U.S. Cl. ..... 362/235; 362/260; 362/247; 362/249

(58) Field of Search ..... 362/260, 235, 362/249, 247

(56) References Cited

U.S. PATENT DOCUMENTS

| | | | | |
|---|---|---|---|---|
| 305,200 | A | | 9/1884 | Klein, Jr. |
| 1,022,878 | A | | 4/1912 | D'A Ryan |
| 1,349,478 | A | | 8/1920 | Sugimura |
| 1,552,121 | A | | 9/1925 | Dau |
| 1,889,567 | A | | 11/1932 | Persons |
| 1,961,116 | A | | 5/1934 | Van Braam Van Vloten |
| 2,107,028 | A | | 2/1938 | Doane |
| 2,262,586 | A | | 11/1941 | James |
| 2,319,736 | A | | 5/1943 | Jarmolowsky |
| 2,323,172 | A | | 6/1943 | Wittaker |
| 2,976,399 | A | | 3/1961 | Christy |
| 3,141,620 | A | | 7/1964 | Geggemos |
| 3,144,633 | A | | 8/1964 | Germain |
| 3,777,138 | A | | 12/1973 | Metzler |
| 4,004,144 | A | | 1/1977 | Chako |
| 4,219,869 | A | | 8/1980 | Bowman et al. |
| 4,651,257 | A | | 3/1987 | Gehly |
| 4,704,664 | A | | 11/1987 | McNair |
| 5,067,064 | A | | 11/1991 | Gehly et al. |
| 5,192,126 | A | | 3/1993 | Remeyer et al. |
| 5,546,291 | A | | 8/1996 | Simes |
| 5,667,736 | A | * | 9/1997 | Chien ..... 264/2.5 |
| RE36,414 | E | | 11/1999 | Tickner |
| 6,024,468 | A | | 2/2000 | Kassay et al. |
| 6,109,766 | A | | 8/2000 | Baliozian |
| 6,338,564 | B1 | * | 1/2002 | Jordan et al. ..... 362/346 |
| 6,447,147 | B1 | * | 9/2002 | Kramer et al. ..... 362/297 |

FOREIGN PATENT DOCUMENTS

| | | |
|---|---|---|
| DE | 846383 | 8/1952 |
| DE | 193493 | 2/1957 |
| DE | 322476 | 7/1957 |
| EP | 0 344 627 | 5/1989 |
| FR | 537370 | 5/1922 |
| FR | 580.397 | 11/1924 |
| FR | 977.356 | 3/1951 |
| FR | 1.109.705 | 2/1956 |
| GB | 1116066 | 6/1968 |
| GB | 2 248 293 | 4/1992 |
| IT | 301050 | 2/1932 |
| IT | 545511 | 7/1956 |
| SE | 168010 | 9/1950 |
| SE | 135146 | 4/1952 |

* cited by examiner

*Primary Examiner*—Sandra O'Shea
*Assistant Examiner*—Guiyoung Lee
(74) *Attorney, Agent, or Firm*—John F. Salazar; James E. Cole; Middleton Reutlinger

(57) ABSTRACT

A high bay compact fluorescent light fixture having a reflector/refractor mounted to a socket mounting plate assembly having a top portion, a bottom portion, and at least one sidewall. Removably mounted to the top portion of the socket mounting plate assembly is a ballast housing having a plurality of lamp powering ballasts located therein. A plurality of sockets are mounted to the bottom portion of the socket mounting plate assembly. The high bay compact fluorescent light fixture design eliminates the need for a collar to connect the reflector/refractor to the fixture and further makes the design more compact.

21 Claims, 9 Drawing Sheets

HIGH BAY COMPACT FLUORESCENT LIGHT FIXTURE

BACKGROUND OF THE INVENTION

1. Technical Field of the Invention

The present invention relates to a high bay fluorescent light fixture. More particularly, the invention provides a high bay light fixture having a compact design in which the reflector/refractor is supported by a socket mounting plate assembly.

2. Description of the Related Art

Various light fixture designs used in high bay applications use a collar to attach a reflector/refractor to a fixture assembly. However, the use of a collar requires more vertical space between the light fixture and the reflector as well as causing higher manufacturing and assembly costs. This cost, in turn must be passed on to the consumer of the light fixture.

In view of the deficiencies in the known high bay light fixtures it is apparent that a light fixture is needed eliminating the use of a collar and having a compact design, good illumination characteristics, as well as easy assembly.

SUMMARY OF THE INVENTION

It is an object of the present invention to have a high bay fluorescent light fixture with a compact mounting plate design.

It is a further object of this invention to eliminate the need for having a collar to support a reflector/refractor.

It is still an even further object of this invention to support the reflector/refractor from the socket mounting plate assembly.

More particularly the invention comprises a high bay compact fluorescent light fixture, having a reflector/refractor with a first end and a second larger end, a socket mounting plate assembly having a top portion, a bottom portion, and at least one sidewall, each of the at least one sidewall connecting the top portion and the bottom portion, the top portion having a ledge around a peripheral edge and an upper bracket attaching the reflector/refractor to the socket mounting plate assembly, a plurality of substantially equidistantly spaced sockets depending from the socket mounting plate assembly, and a ballast housing removably attached to the top portion of the socket mounting plate assembly having a plurality of lamp powering ballasts therein in electrical communication with the plurality of sockets.

The high bay compact fluorescent light fixture of the present invention has a socket mounting plate assembly with vertical sidewalls and at least one upper bracket extending from the at least one sidewall through the top portion. The upper bracket and the ledge retain the reflector/refractor to the socket mounting plate assembly. Alternatively, the socket mounting plate assembly may have angled or bevelled sidewalls. The at least one sidewall is comprised of a plurality of brackets.

The high bay compact fluorescent light fixture has a plurality of sockets mounted in a plane which may be normal to the socket mounting plate assembly. The high bay compact fluorescent light fixture has a reflector/refractor which may be acrylic and translucent.

Alternatively, the high bay fluorescent light fixture may or may not have a socket mounting plate assembly of unitary construction. If a non-unitary construction is used the high bay compact fluorescent light fixture may further comprise a retaining clip for holding the bottom portion against a peripheral edge of the angled or beveled sidewall.

All of the above outlined objectives are to be understood as exemplary only and many more objectives of the invention may be gleaned from the disclosure herein. Therefore, no limiting interpretation of the objectives noted are to be understood without further reading of the entire specification, claims and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 1:
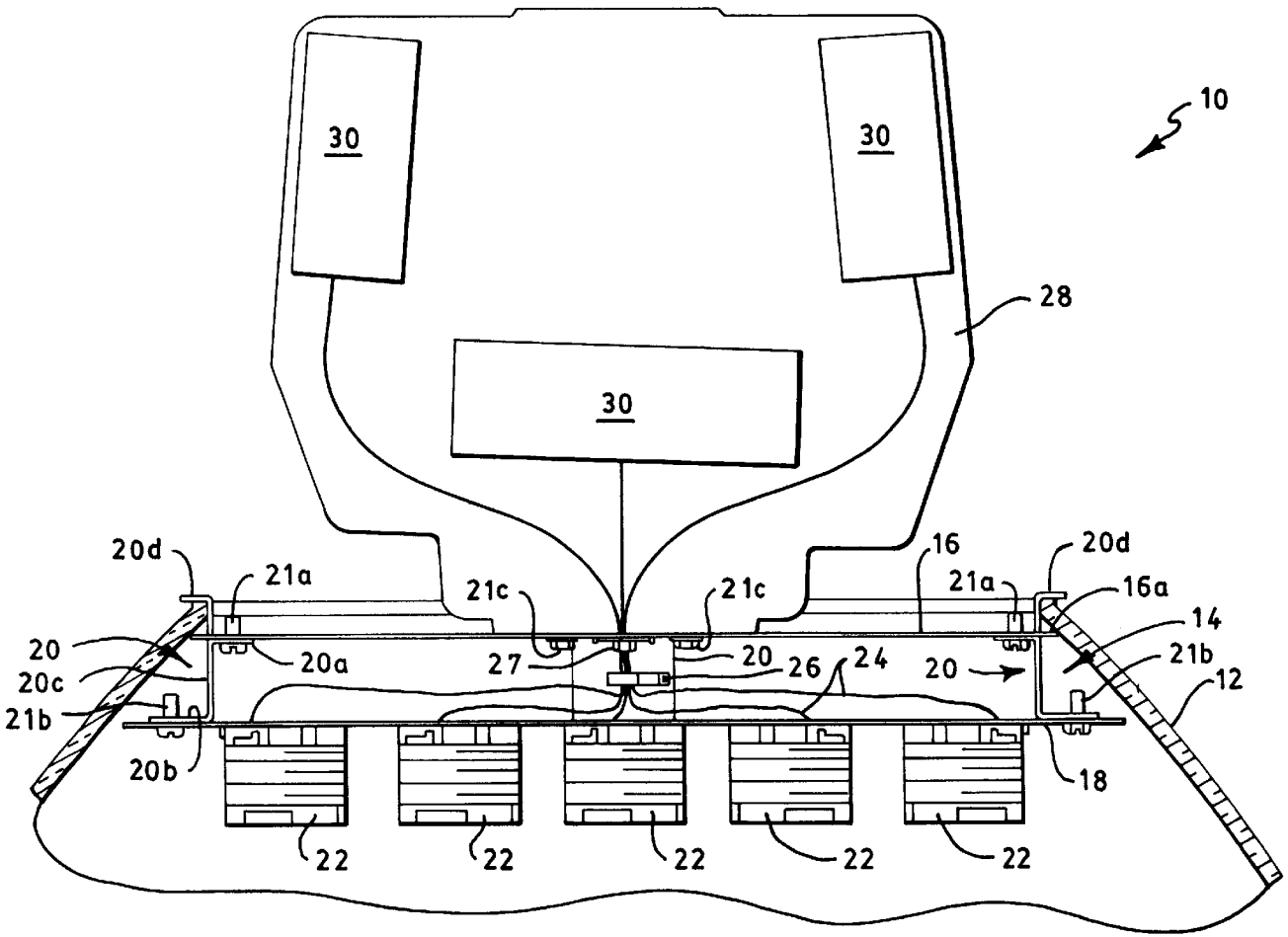
FIG. 1 shows a side sectional view a preferred embodiment of the present invention.
Figure 2:
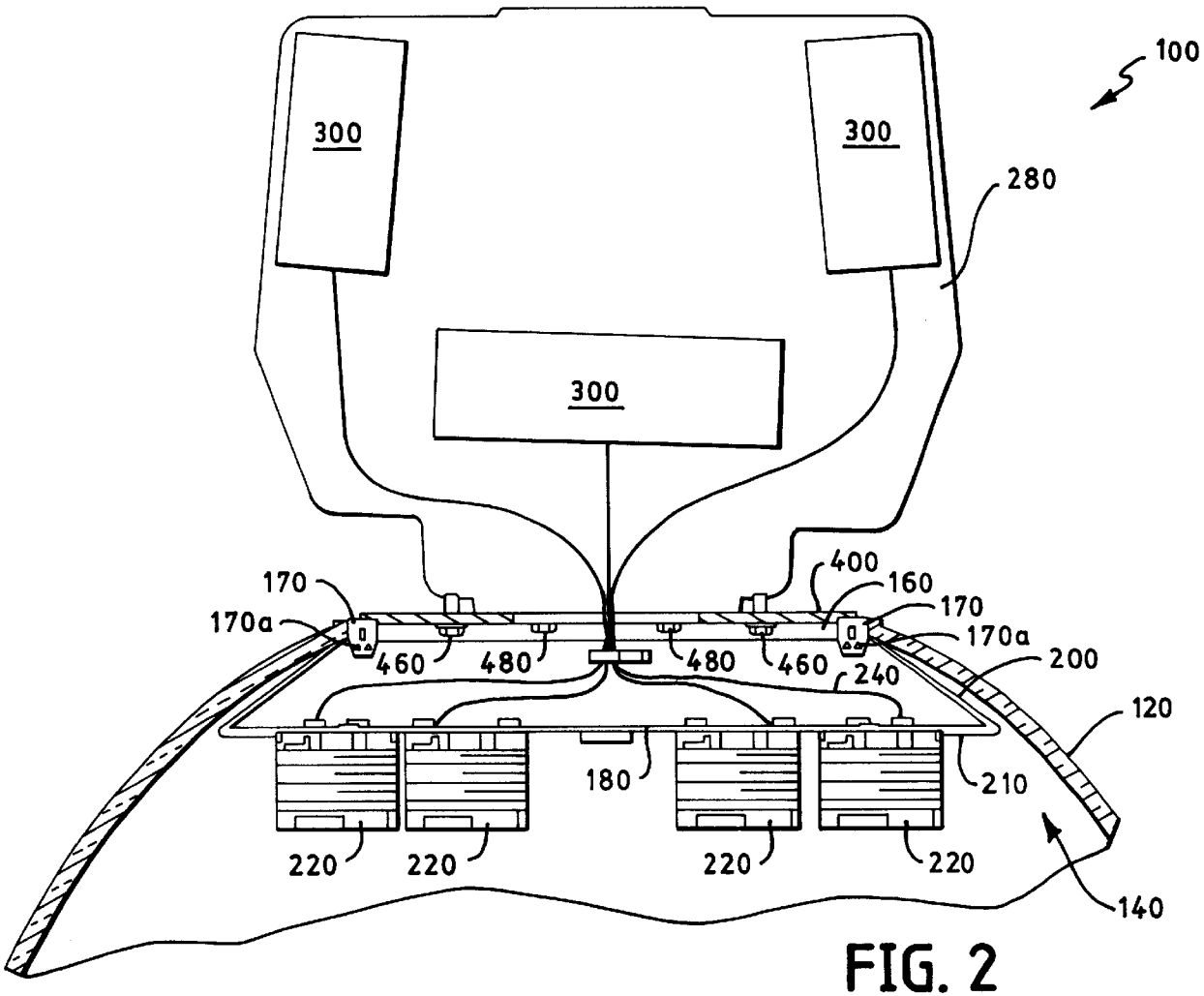
FIG. 2 shows a side sectional view of an alternative embodiment of the present invention.
Figure 3:
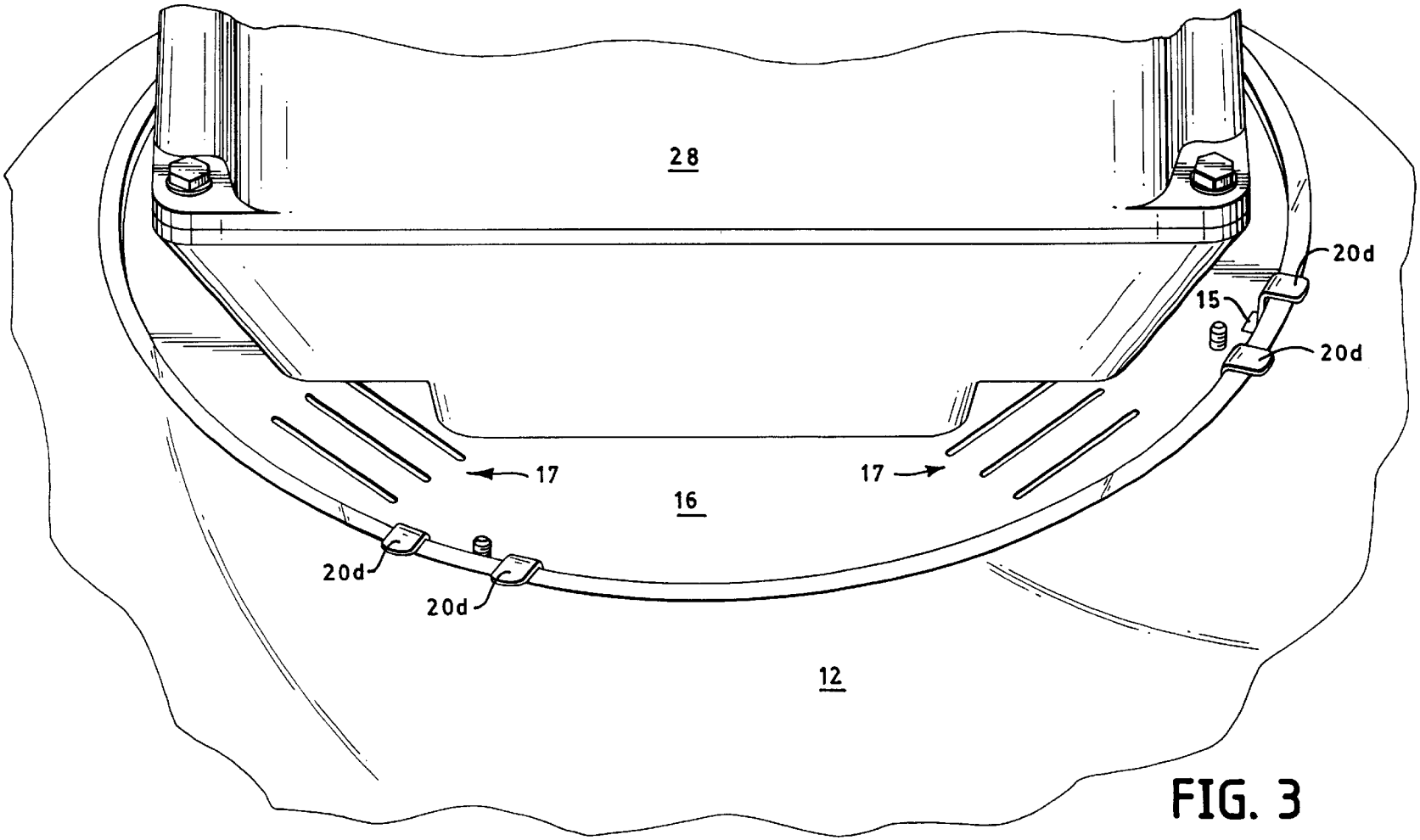
FIG. 3 shows a perspective view of a top portion of the socket mounting plate assembly and ballast housing of FIG. 1.
Figure 4:
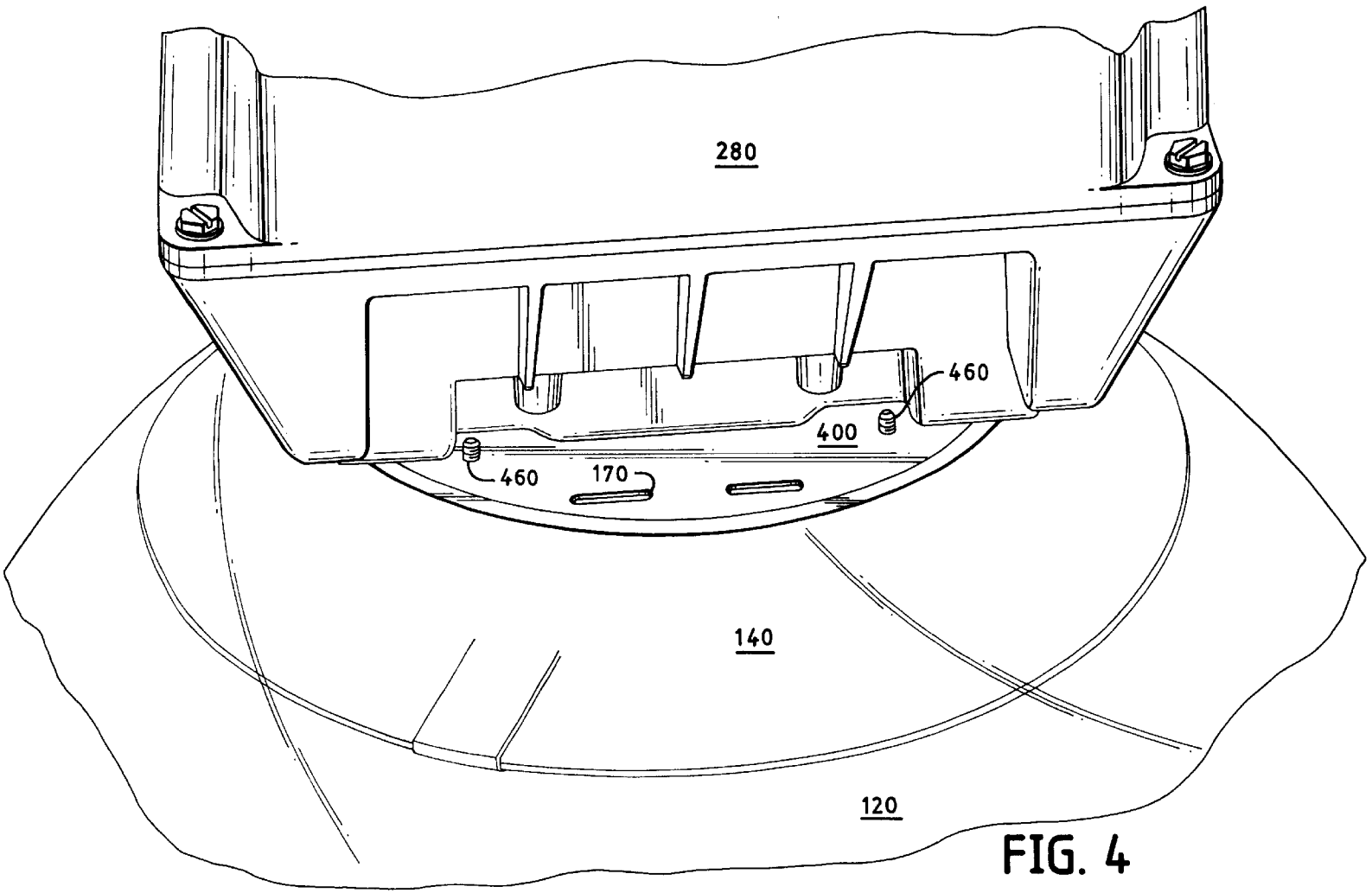
FIG. 4 shows a perspective view of an adapter plate and ballast housing of the alternative embodiment of FIG. 2.
Figure 5:
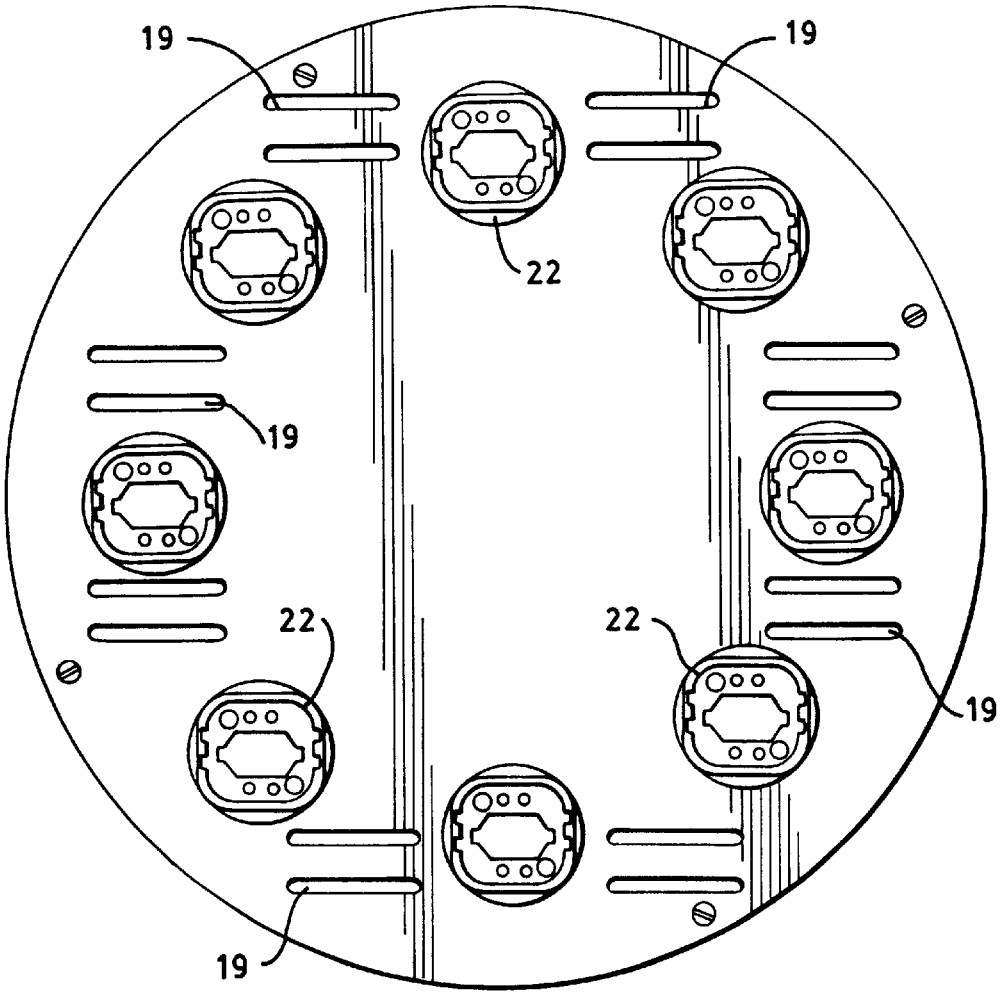
FIG. 5 shows a bottom view of the bottom portion of the socket mounting plate assembly.

Referring initially to FIGS. 1 and 3, a side sectional view and a top perspective view of a preferred embodiment of the high bay compact fluorescent light fixture 10 are shown. The light fixture 10 has a concave reflector/refractor 12 which is generally symmetrical about a vertical centerline extending through the light fixture. A reflector or refractor 12 may be used interchangeably as needed. If a reflector is used then it may be preferably made of aluminum and if a refractor is used it may be made of acrylic or some other like material having angled prisms or other surface for light direction or diffusion. The reflector/refractor 12 preferably has a bell shape with a first end and a larger second end. The reflector/refractor 12 depends directly from a socket mounting plate assembly 14 and eliminates the need for the use of a supporting collar which is prevalent in the prior art.

Figure 9:
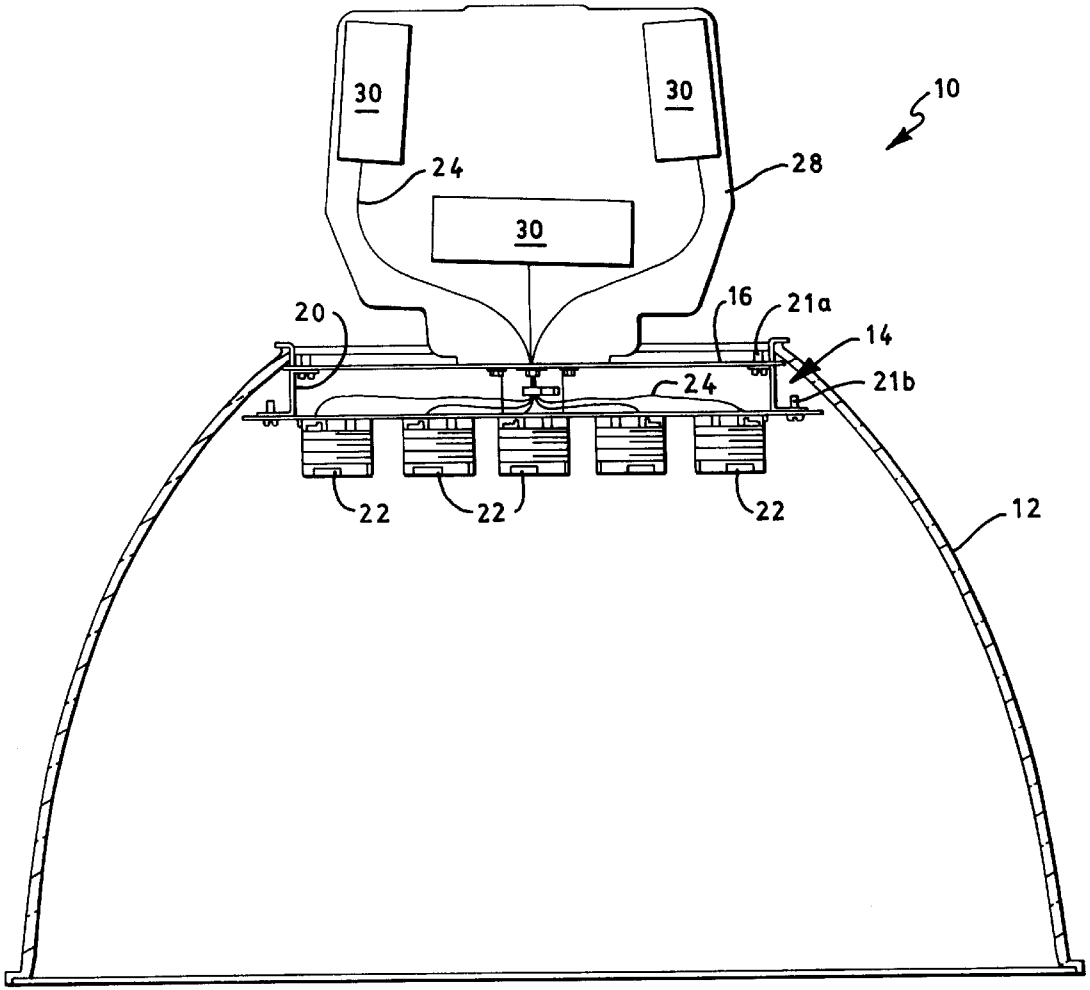

Socket mounting plate assembly 14 is comprised of a top portion 16, a bottom portion 18, and sidewalls 20 as shown in FIGS. 1 and 9. Top portion 16 has a flat circular plate with holes 15 near its peripheral edge. Upper brackets **20*d* extend through each hole 15 from below the top portion 16. The top portion 16 extends radially beyond the hole 15 forming a peripheral ledge 16*a*. Upper brackets 20*d* serve as an upper resting position for reflector/refractor 12 and work in cooperation with peripheral ledge 16*a* to retain reflector/refractor 12 to the socket mounting plate assembly 14. More precisely, upper brackets 20*d* and ledge 16*a* sandwich the upper edge or rim of reflector/refractor 12 and thereby eliminate any vertical or horizontal movement of the reflector/refractor 12**.

As best seen in FIGS. 1, 3, 5 and 9 the top portion 16 and the bottom portion 18 have a plurality of slots therein 17 and 19 through which heat is dissipated. Heat, which builds up from the lamps 221 positioned in light sockets 22, escapes upward through bottom portion slots 19 and through top portion slots 17. Thus heat that would be retained with reflector/refractor 12 is dissipated appropriately.

Removably connected by screws 21*a* to the bottom of the top portion 16 of the socket mounting plate assembly 14 are sidewalls 20. There are preferably four segmented sidewalls 20, ninety degrees apart, each comprising a bracket, but the sidewalls 20 may alternatively be a continuous wall between the top and bottom portions 16 and 18. Sidewalls 20 are shown having a vertical member 20*c* and first and second horizontal members 20*a* and 20*b*. However, one skilled in the art will recognize that various geometric configurations can be used to form the sidewalls 20. Two upper brackets 20*d* are extending vertically from each sidewall 20. As described above, each upper bracket 20*d* extends through a hole 15 in the top portion 16 of socket mounting plate assembly 14 to provide an upper resting position for reflector/refractor 12. Brackets 20*d* also provide support of the load exerted by the ballast housing 28 and support the weight thereof.

Figure 6:
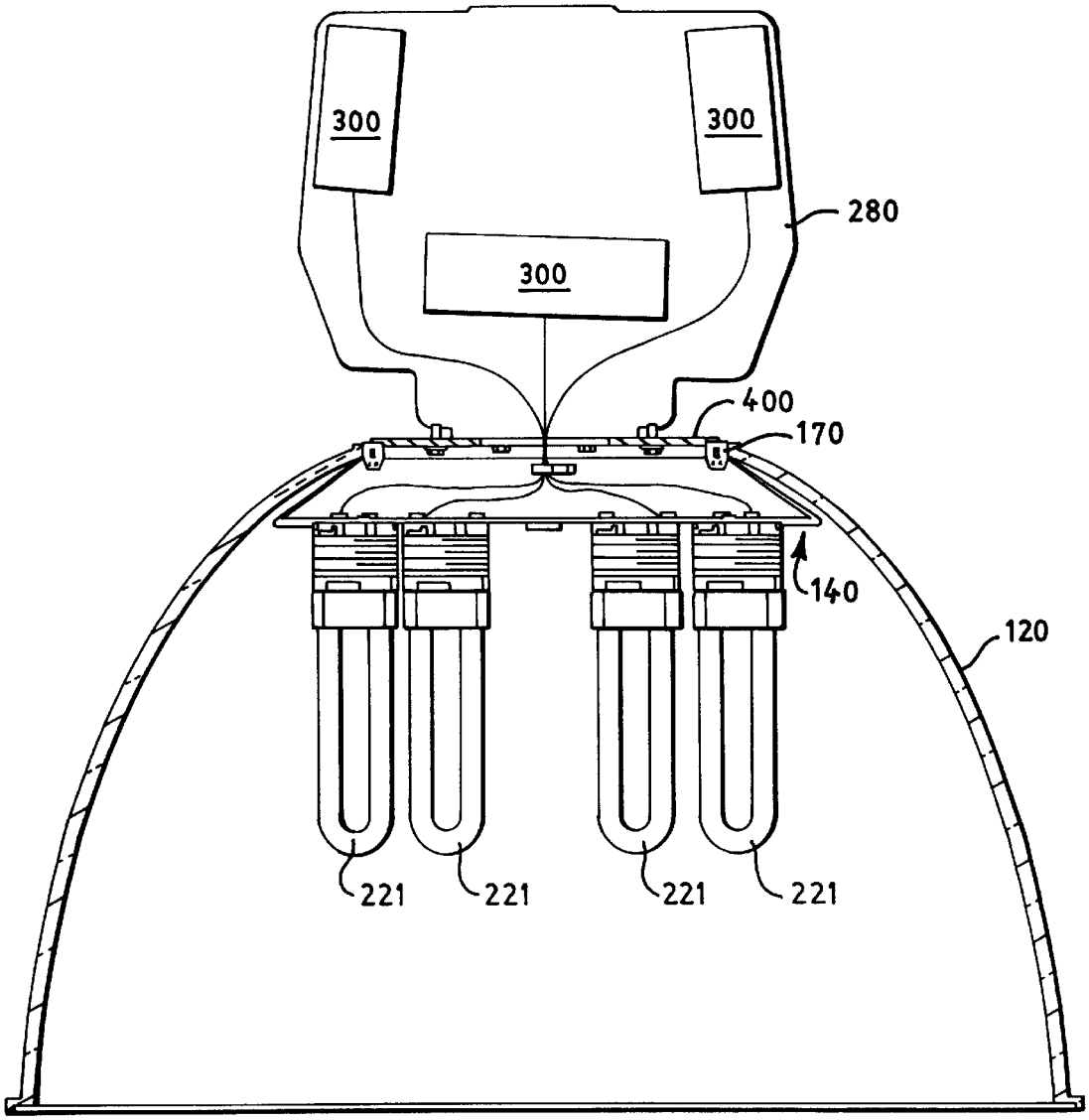
FIG. 6 shows a side view of an alternative embodiment of the present invention shown in FIG. 2.
Figure 7:
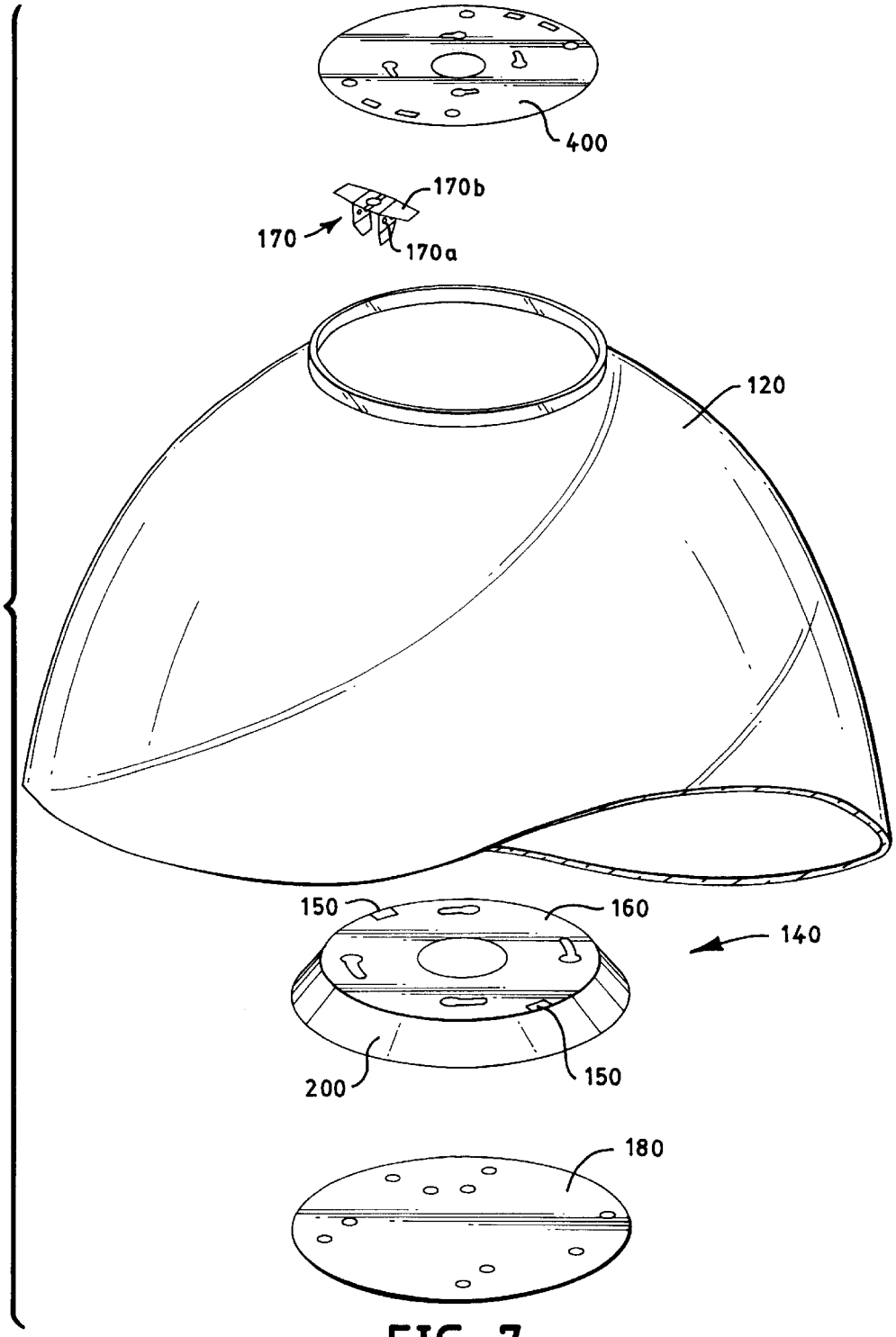
FIG. 7 shows an assembly view of the alternative embodiment in FIG. 2.

Removably connected by screw 21*b* to second horizontal member 20*b* of sidewall 20 is a bottom portion 18 of socket mounting plate assembly 14. Fixedly attached to bottom portion 18 are a plurality of sockets 22. The plurality of sockets 22 are preferably circumferentially and equidistantly spaced about a central vertical axis of the light fixture 10. Moreover the plurality of sockets 22 are preferably adapted to accept compact fluorescent lamps 221 (as shown in FIG. 6) in a plane which may be normal to the socket mounting plate assembly 14. This causes light to be directed vertically downward, on for instance merchandise or aisles, as necessary in a building having a high bay. However, various configurations and angles of lamp mountings may be used with the socket mounting plate of the present invention.

FIG. 1 also shows wiring 24 from each of the plurality of sockets 22 for electrical communication with lamp powering ballasts 30. Wiring 24 runs from sockets 22 through a sleeve or tie wrap 26 and through hole 27 in top portion 16 of socket mounting plate assembly 14 into ballast housing 28 where the lamp powering ballasts 30 are located. Ballast housing 28 is removably connected to the top portion 16 of socket mounting plate assembly 14 near the first end of the reflector/refractor 12. The connection can be made by, for instance, screws 21*c* but is not limited to this type of connection. The lamp powering ballasts 30 are also in electrical communication with a power supply (not shown) such that the fixture 10 will operate. Since the reflector/refractor 12 is held in place by the socket mounting plate assembly 14, the use of a collar is eliminated and, in turn, decreases manufacturing and assembly costs.

Now referring to FIGS. 2, 4, 6, and 7 a smaller alternative embodiment of the present invention is shown. The smaller high bay compact fluorescent light fixture 100 comprises a socket mounting plate assembly 140, having angled or beveled sidewalls 200 instead of vertical sidewalls as shown in FIG. 1. As with the first embodiment, this alternative embodiment eliminates the need for a collar to mount the reflector/refractor 120 because the reflector/refractor 120 is mounted directly to the socket mounting plate assembly 140.

Socket mounting plate assembly 140 is shown as a unitary constructed member having a top portion 160, a bottom portion 180, and angled or beveled sidewalls 200. The angled sidewalls 200 are made of a reflective material and substantially prevent uplighting.

The socket mounting plate assembly 140 is located within an upper area of the reflector/refractor 120 and held in place by clips 170. Clips 170 are inserted through holes 150 (best shown in FIG. 7) in top portion 160 of socket mounting plate assembly 140. Clips 170 have teeth 170*a* which are pressed through holes 150 in top portion 160 and hold the reflector/refractor 120 in place within the upper area of reflector/refractor 120. The clips 170 also have wings 170*b*, shown in FIG. 7, which act to keep the top portion 160 flush with the top of the reflector/refractor 120. There are preferably 2 clips 170 and holes 150.

An adapter plate 400 may be connected to top portion 160 of socket mounting plate assembly 140 by screws 460. Adapter plate 400 also is connected to ballast housing 280 by screws 480.

The bottom portion 180 of socket mounting plate assembly 140 has a plurality of sockets 220 mounted thereto for receiving fluorescent lamps 221 . Each socket 220 is in electrical communication with lamp powering ballasts 300 housed in ballast housing 280 via wiring 240. The sockets 220 are electrically independent such that if one socket stops working the others will continue to provide illumination.

Figure 8:
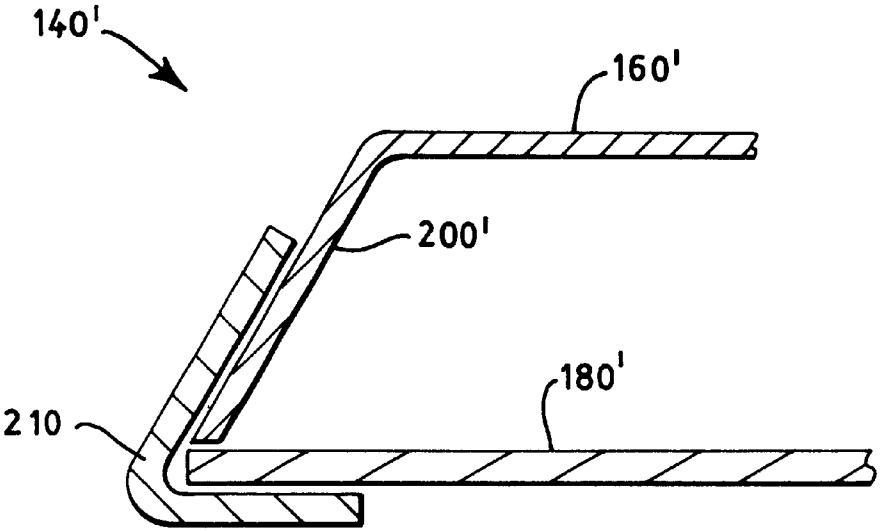
FIG. 8 shows a retaining clip used for connecting the bottom portion of the socket mounting plate assembly depicted in FIG. 2; and, FIG. 9 shows a full side view of the preferred embodiment shown in FIG. 1.

In an alternative embodiment, shown in FIG. 8, sidewall socket mounting plate assembly 140' has a top portion 160' and sidewalls 200' having a unitary construction. However, bottom portion 180' of socket mounting plate assembly 140' is connected to sidewalls 200' by retaining clip 210. The retaining clip 210 may be substantially v-shaped.

To summarize, the present invention provides a high bay compact fluorescent light fixture comprising a reflector/refractor, a socket mounting plate assembly having a top portion, a bottom portion, and sidewalls. A ballast housing is connected to the top portion of the socket mounting plate assembly having a plurality of lamp powering ballasts located therein in electrical communication with a plurality of fluorescent lighting sockets.

The invention may be embodied in various forms without departing from its spirit and essential characteristics. The described embodiments are not to be considered as restrictive.

I claim:

1. A compact fluorescent light fixture, comprising:

a concave reflector/refractor having an opening at a top end;

a socket mounting plate assembly having a top portion, a bottom portion, and a side wall therebetween;

said sidewall having at least one upper bracket extending from above said concave reflector/refractor downwardly and affixed to said bottom portion;

said top end of said concave reflector/refractor disposed between a peripheral edge of said top portion and said upper bracket;

a plurality of sockets mounted on said bottom portion of said socket mounting plate assembly;

a ballast housing having a plurality of ballasts therein electrically connected to said plurality of sockets;

wherein said top portion of said socket mounting plate contacts said reflector/refractor on an interior surface thereof below said opening at said top end.

2. The light fixture of claim 1 wherein said side wall of said socket mounting plate assembly is continuous.

3. The light fixture of claim 2 wherein said side wall of said socket mounting plate assembly is angled.

4. The light fixture of claim 3 wherein said side wall of said socket mounting plate assembly further has a plurality of retaining clips affixing said side wall of said socket mounting plate assembly to said bottom portion.

5. The light fixture of claim 4 further comprising an adapter plate affixed to said top portion of said socket mounting plate assembly, said adapter plate removably attached to said ballast housing.

6. The light fixture of claim 5 wherein said plurality of brackets are a plurality of clips, each of said clips having teeth formed on a bottom leg thereof, said teeth contacting said interior surface of said refractor below said opening at said top end.

7. The light fixture of claim 1 wherein said side wall of said socket mounting plate assembly is segmented.

8. The light fixture of claim 7 wherein said side wall of said socket mounting plate assembly is vertical.

9. The light fixture of claim 7 wherein said sidewall has two vertically extending upper brackets.

10. A light fixture, comprising:

a concave refractor having an opening at a top end;

a socket mounting plate assembly having a top portion, a bottom portion and a side wall therebetween;

a plurality of sockets mounted on said bottom portion of said socket mounting plate assembly;

a plurality of brackets affixed to said top portion of socket mounting plate assembly and supporting said socket mounting plate assembly to said opening at said top end of said refractor;

a ballast housing having a plurality of ballasts therein electrically connected to said plurality of sockets;

an adapter plate affixed to said top portion of said socket mounting plate assembly, said adapter plate removably attached to said ballast housing;

wherein said top portion of said socket mounting plate contacts said refractor on an interior surface thereof below said opening at said top end and wherein said side wall of said socket mounting plate assembly further has a plurality of retaining clips affixing said side wall of said socket mounting plate assembly to said bottom portion; and, wherein said plurality of brackets are a plurality of clips, each of said clips having teeth formed on a bottom leg thereof, said teeth contacting said interior surface of said refractor below said opening at said top end.

11. A light fixture, comprising:

a reflector/refractor having a first end and a larger second end;

a socket mounting plate assembly having a top portion, a bottom portion, and at least one sidewall, each of said at least one sidewall connecting said top portion and said bottom portion;

said top portion having a ledge around a peripheral edge and said sidewall having at least one upper bracket attaching said reflector/refractor to said socket mounting plate assembly;

a plurality of substantially equidistantly spaced sockets depending from said bottom portion of said socket mounting plate assembly; and, a ballast housing removably attached to said top portion of said socket mounting plate assembly having a plurality of lamp powering ballasts therein in electrical communication with said plurality of sockets;

wherein said sidewall extends through said top wall defining said at least one upper bracket.

12. The light fixture of claim 11, wherein said socket mounting plate assembly has vertical sidewalls.

13. The light fixture of claim 11, wherein said upper bracket and said ledge compress a top edge of said first end of said reflector/refractor to maintain said reflector/refractor adjacent to said socket mounting plate assembly.

14. The light fixture of claim 11, wherein said plurality of sockets are mounted in a plane normal to said bottom portion of said socket mounting plate assembly.

15. The light fixture of claim 11, wherein said at least one sidewall is comprised of a plurality of brackets.

16. The light fixture of claim 11, where said reflector/refractor is acrylic.

17. The light fixture of claim 11, where in said reflector/refractor is translucent.

18. A light fixture, comprising:

a reflector/refractor having a first end and a second larger end;

a socket mounting plate assembly having a top portion, a bottom portion, and a connecting sidewall, said sidewall connecting said top portion and said bottom portion and being angled, said top portion having a plurality of holes therein;

a retaining clip holding said socket mounting plate assembly to said opening at said top end of said reflector/refractor and flush with a top edge of said reflector/refractor;

a plurality of substantially equidistantly spaced sockets depending from said socket mounting plate assembly; and, an adapter plate removably connected to said top portion of said socket mounting plate assembly and a ballast housing, said ballast housing having a plurality of lamp powering ballasts therein in electrical communication with said plurality of sockets.

19. The light fixture of claim 18, wherein said socket mounting plate assembly is of unitary construction.

20. The light fixture of claim 18, further comprising a retaining clip for holding said bottom portion against a peripheral edge of said angled sidewall.

21. A light fixture comprising:

a reflector/refractor having a first end and a second larger end;

a socket mounting plate assembly having a top portion, a bottom portion, and at least one sidewall, each of said at least one sidewall connecting said top portion and said bottom portion;

said top portion having a ledge around a peripheral edge and said sidewall having at least one upper bracket for attaching said reflector/refractor to said socket mounting plate assembly;

wherein said at least one sidewall defines said at least one upper bracket extending through said top portion and said sidewall extends downwardly to said bottom portion;

wherein said upper bracket and said ledge compress said reflector/refractor to maintain said reflector/refractor against said socket mounting plate assembly.

* * * * *

UNITED STATES PATENT AND TRADEMARK OFFICE

CERTIFICATE OF CORRECTION

PATENT NO. : 6,575,594 B1
DATED : October 17, 2003
INVENTOR(S) : Andy Ali Jaffari It is certified that error appears in the above-identified patent and that said Letters Patent is hereby corrected as shown below:

Title page,
Item [12] and Item [75], Inventor, correct the spelling of inventor "Jafari" to read -- Jaffari --.

Signed and Sealed this

Ninth Day of December, 2003

JAMES E. ROGAN
*Director of the United States Patent and Trademark Office*